US006701722B1

(12) United States Patent
Seo et al.

(10) Patent No.: US 6,701,722 B1
(45) Date of Patent: Mar. 9, 2004

(54) AIR CONDITIONER AND METHOD OF DETECTING REFRIGERANT LEAKAGE THEREIN

(75) Inventors: Hyeong-Joon Seo, Suwon (KR); Gyoo-Ha Jung, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/295,961

(22) Filed: Nov. 18, 2002

(30) Foreign Application Priority Data

May 1, 2002 (KR) ..... 2002-23992

(51) Int. Cl.[7] ..... F25B 45/00; G01K 13/00
(52) U.S. Cl. ..... 62/77; 62/129
(58) Field of Search ..... 62/129, 126, 77; 165/11.1; 236/94

(56) References Cited

U.S. PATENT DOCUMENTS 4,922,999 A * 5/1990 Stokes et al. ..... 165/40
5,044,168 A * 9/1991 Wycoff ..... 62/126
5,186,014 A * 2/1993 Runk ..... 62/129
5,524,445 A 6/1996 Morrow et al. ..... 62/129
6,098,412 A * 8/2000 Porter et al. ..... 62/126
6,205,798 B1 * 3/2001 Porter et al. ..... 62/129

* cited by examiner

*Primary Examiner*—Marc Norman
(74) *Attorney, Agent, or Firm*—Staas & Halsey LLP

(57) ABSTRACT

An air conditioner and method of detecting a refrigerant leakage in the air conditioner in which the entire refrigerant pipe of the air conditioner is sectioned based on expansion valves into a plurality of sections, the sections are checked one by one to quickly detect a refrigerant leakage from the sections and an exact position of a broken or loosened area of the refrigerant pipe causing such a refrigerant leakage is found. In the method of detecting a refrigerant leakage in the air conditioner, comprising a compressor, an expansion valve, an outdoor heat exchanger, and an indoor heat exchanger connected to one another by a refrigerant pipe, the refrigerant pipe is sectioned into a high pressure section extending from the outlet port of the compressor to the inlet port of the expansion valve, and a low pressure section extending from the outlet port of the expansion valve to the inlet port of the compressor. A pressure sensor is provided on the refrigerant pipe within the low pressure section. A control unit detects a refrigerant leakage in the low pressure section by comparing a variation in refrigerant pressure sensed by the pressure sensor with a preset variation in the refrigerant pressure in accordance with a normal operation without the refrigerant pipe having a refrigerant leakage, during a refrigerant leakage detection mode.

26 Claims, 14 Drawing Sheets

AIR CONDITIONER AND METHOD OF DETECTING REFRIGERANT LEAKAGE THEREIN

CROSS-REFERENCE TO RELATED APPLICATION

This application claims the benefit of Korean Application No. 2002-23992, filed May 1, 2002, in the Korean Industrial Property Office, the disclosure of which is incorporated herein by reference.

BACKGROUND OF THE INVENTION

1. Field of the Invention

The present invention relates, in general, to air conditioners and, more particularly, to a multiunit-type air conditioner having a plurality of indoor units and used for heating or cooling indoor air, and to a method of detecting a refrigerant leakage in the air conditioner.

2. Description of the Related Art

Air conditioners are machines that control the indoor temperatures by transferring heat between refrigerant and indoor/outdoor air. FIG. 1 is a schematic view showing a construction and refrigerant flow of a conventional air conditioner, in which arrows show a refrigerant flowing direction during a cooling mode operation of the air conditioner. As shown in FIG. 1, the conventional air conditioner comprises an indoor unit 102 and an outdoor unit 104, with an indoor heat exchanger 116 installed in the indoor unit 102. The indoor heat exchanger 116 is a device at which heat is transferred between the refrigerant and indoor air. The indoor unit 102 also has an indoor expansion valve 114 which regulates pressure of the refrigerant flowing to the indoor heat exchanger 116 during a cooling mode operation. Two or more indoor units 102 each having the above-mentioned construction may be arranged in parallel as desired to form a multiunit-type air conditioner.

The outdoor unit 104 comprises an outdoor heat exchanger 122 and a compressor 118. The outdoor heat exchanger 122 is a device at which heat is transferred between the refrigerant and outdoor air. The compressor 118 sucks low temperature and low pressure refrigerant, and compresses the low temperature and low pressure refrigerant to make high temperature and high pressure refrigerant prior to discharging the refrigerant from the compressor 118. The outdoor unit 104 also has an outdoor expansion valve 128 which regulates pressure of the refrigerant flowing to the outdoor heat exchanger 122 during a heating mode operation. A four-way valve 130 is mounted on a refrigerant circulating line in the outdoor unit 104, and controls a flowing direction of an output refrigerant from the compressor 118 such that the output refrigerant flows to the outdoor heat exchanger 122 or the indoor heat exchanger 116 in accordance with a selected mode of the air conditioner.

Extending between the indoor unit 102 and the outdoor unit 104 of the air conditioner is the refrigerant circulating line (refrigerant pipe) which guides the flow of the refrigerant between the indoor unit 102 and the outdoor unit 104. Particularly in the case of a multiunit-type air conditioner having a plurality of indoor units 102, the refrigerant pipe is very long in length and somewhat complex in construction, and so by integrating a plurality of short pipes having an easily-handled length to each other to form a long and complex refrigerant pipe through, for example, a welding process is necessary. However, when the welding process is not effectively or sufficiently performed at welded junctions of the refrigerant pipe or when the refrigerant pipe is not properly managed after an installation of the pipe in the air conditioner, the refrigerant pipe may be broken at the welded junctions and undesirably allow a refrigerant leakage through the broken junctions. Further, repeated operation of the air conditioner over a lengthy period of time causes the refrigerant pipe to gradually become fatigued, and, in such a case, the refrigerant pipe may be loosened at connected junctions of the refrigerated pipe, thus allowing a refrigerant leakage through the loosened junctions. When the refrigerant leakage from the refrigerant pipe occurs, the air conditioner cannot perform an operation of the air conditioner. Therefore, in such a case, a user of the air conditioner must find positions of broken or loosened junctions of the refrigerant pipe to quickly repair the refrigerant pipe and restore a desired operation of the air conditioner.

The refrigerant leakage from the refrigerant pipe of an air conditioner has been detected by checking a variation in pressure of the output refrigerant from the compressor. However, this method only informs a user of an occurrence of the refrigerant leakage from the refrigerant pipe, but does not allow the user to find exact positions of the broken or loosened areas of the refrigerant pipe, and so the user cannot easily or quickly repair the broken or loosened refrigerant pipe. In the case of a multiunit-type air conditioner having a very long and complex refrigerant pipe, to find the exact positions of the broken or loosened areas of the refrigerant pipe is more important than to detect an occurrence of the refrigerant leakage from the refrigerant pipe. However, to find the exact positions of broken or loosened areas of the long and complex refrigerant pipe is very difficult. Particularly, in the case of a building with a centralized air conditioning system, the refrigerant pipe of an air conditioning system is typically installed in the building at the same time as constructing the building such that the refrigerant pipe is hidden in walls, ceilings and floors. Therefore, to find the exact positions of the broken or loosened areas of the pipe in the case of a refrigerant leakage is even more difficult.

SUMMARY OF THE INVENTION

Accordingly, an air conditioner and a method of detecting a refrigerant leakage in the air conditioner are provided, in which an entire refrigerant pipe of the air conditioner is sectioned based on expansion valves into a plurality of sections, and the sections are checked one by one to quickly detect a refrigerant leakage from the sections, as well as to find an exact position of a broken or loosened area of the refrigerant pipe causing the refrigerant leakage.

Additional aspects and advantages of the invention will be set forth in part in the description which follows and, in part, will be obvious from the description, or may be learned by practice of the invention.

In order to accomplish the above and other aspects, the present invention provides an air conditioner, comprising a compressor, an expansion valve, an outdoor heat exchanger, and an indoor heat exchanger connected to each other by a refrigerant pipe, wherein the refrigerant pipe is sectioned into a high pressure section extending from an outlet port of the compressor to an inlet port of the expansion valve, and a low pressure section extending from an outlet port of the expansion valve to an inlet port of the compressor. In the air conditioner, the control unit detects a refrigerant leakage in the low pressure section by comparing a variation in refrigerant pressure, sensed by a pressure sensor provided on the refrigerant pipe within the low pressure section, with a preset variation in the refrigerant pressure in the case of a normal operation without having a refrigerant leakage, during a refrigerant leakage detection mode.

BRIEF DESCRIPTION OF THE DRAWINGS

These and other aspects and advantages of the invention will be come apparent and more readily appreciated from the following description of the preferred embodiments, taken in conjunction with the accompanying drawings of which.

DETAILED DESCRIPTION OF THE PREFERRED EMBODIMENTS

Figure 1:
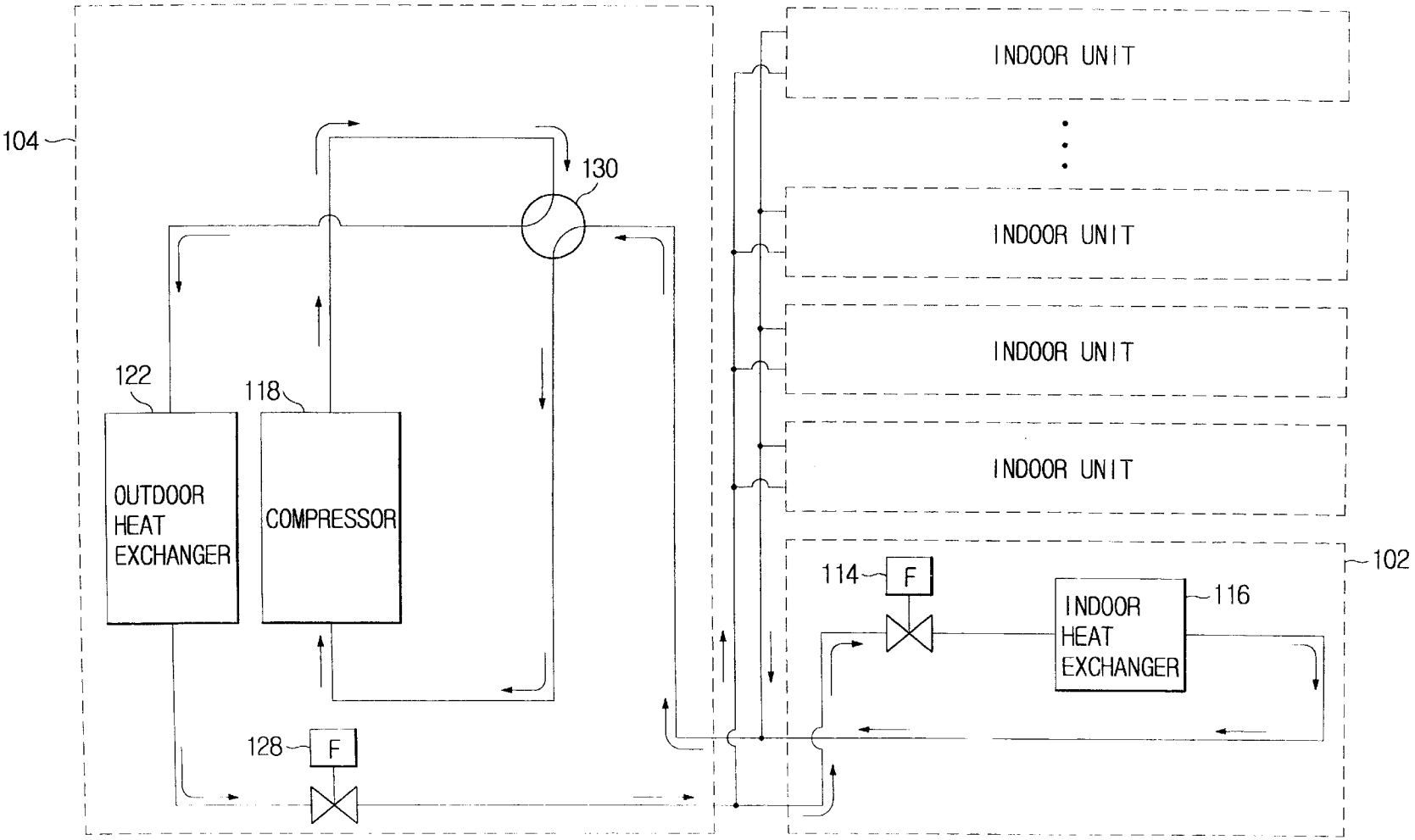
FIG. 1 (PRIOR ART)
FIG. 1 is a block diagram, showing a construction of a conventional, air conditioner.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2A:
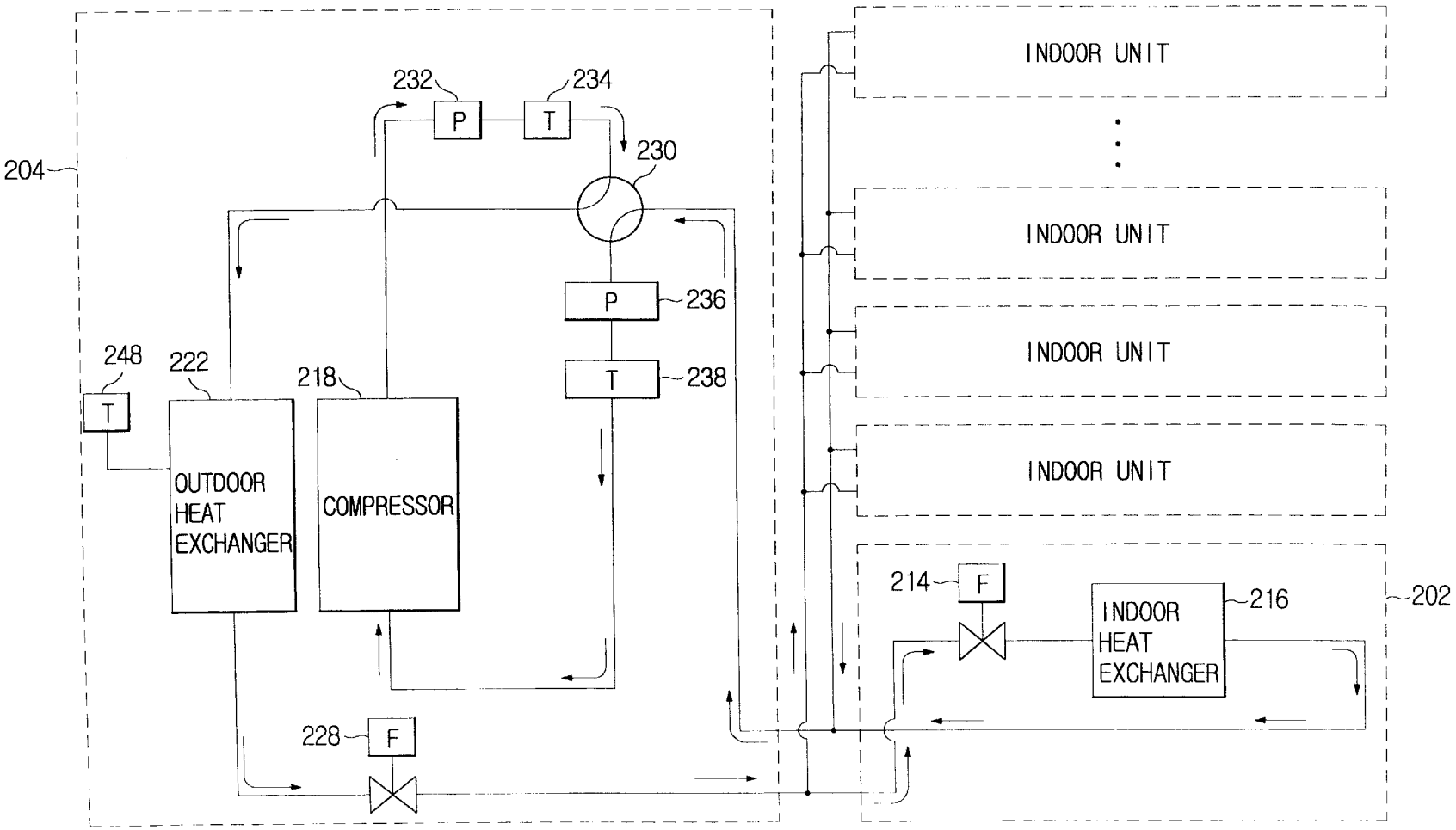
FIG. 2A is a block diagram, showing a construction of an air conditioner in accordance with an embodiment of the present invention.

FIG. 2A is a block diagram, showing the construction of the air conditioner in accordance with an embodiment of this invention, in which the arrows show a refrigerant flowing direction during a cooling mode operation of the air conditioner.

As shown in FIG. 2A, the air conditioner comprises an indoor unit 202 and an outdoor unit 204, with an indoor heat exchanger 216 installed in the indoor unit 202. The indoor heat exchanger 216 is a device at which heat is transferred between refrigerant and indoor air. The indoor unit 202 also has an indoor expansion valve 214 which regulates pressure of the refrigerant flowing to the indoor heat exchanger 216 during a cooling mode operation. The indoor expansion valve 214 is completely opened during a heating mode operation. This indoor expansion valve 214 is used to section first and third detecting sections, which are used in a refrigerant leakage detection mode, as will be described in detail later herein. Two or more indoor units 202 each having the above-mentioned construction may be arranged in parallel as desired to form a multiunit-type air conditioner.

The outdoor unit 204 comprises an outdoor heat exchanger 222 and a compressor 218. The outdoor heat exchanger 222 is a device at which heat is transferred between the refrigerant and outdoor air. The compressor 218 sucks low temperature and low pressure refrigerant, and compresses the low temperature and low pressure refrigerant to make high temperature and high pressure refrigerant prior to discharging the refrigerant. The outdoor unit 204 has an outdoor expansion valve 228 which regulates pressure of the refrigerant flowing to the outdoor heat exchanger 222 during a heating mode operation. The outdoor expansion valve 228 is completely opened during a cooling mode operation. The outdoor expansion valve 228 is used to section a second detecting section, which is used in the refrigerant leakage detection mode, as will be described in detail later herein.

During a normal mode operation of the air conditioner, an opening ratio of each of the two expansion valves 214 and 228 is appropriately controlled to produce the refrigerant pressure required by the indoor units 202. Further, the two expansion valves 214 and 228 are completely opened or closed during a refrigerant leakage detection mode, thus sectioning the refrigerant pipe into the first, second and third detecting sections. In the air conditioner, the electronic expansion valves may be used as the indoor and outdoor expansion valves 214 and 228, since the electronic expansion valves 214 and 228 can be electronically controlled and allow a process of the refrigerant leakage detection to be automatically carried out.

A four-way valve 230 is mounted on the refrigerant pipe in the outdoor unit 204, and controls a flowing direction of output refrigerant from the compressor 218 such that the output refrigerant flows to the outdoor heat exchanger 222 or the indoor heat exchanger 216 in accordance with a selected mode of the air conditioner. An input pressure sensor 236 and an input temperature sensor 238, which are used for the refrigerant leakage detection, are sequentially mounted on the refrigerant pipe between the four-way valve 230 and the inlet port of the compressor 218, and sense the pressure and temperature of input refrigerant flowing to the compressor 218. In the air conditioner, data, representing the pressure and temperature of input refrigerant of the compressor 218 sensed by the two sensors 236 and 238, is used to optimally control an operation of the air conditioner, as well as for the refrigerant leakage detection.

An output pressure sensor 232 and an output temperature sensor 234, which are used for the refrigerant leakage detection, are sequentially mounted on the refrigerant pipe between the outlet port of the compressor 218 and the four-way valve 230. Further, an outdoor temperature sensor 248 is mounted to the outdoor heat exchanger 222. The output pressure sensor 232 detects a variation in the refrigerant pressure in the high pressure section starting at the outlet port of the compressor 218 so as to detect the refrigerant leakage from the refrigerant pipe. The output temperature sensor 234 senses the temperature of output refrigerant discharged from the compressor 218 so as to control the temperature of the output refrigerant of the compressor 218 in accordance with a sensed outdoor temperature. Since there must be a difference, higher than a predetermined level, between the temperatures of the outdoor air and the output refrigerant in order to accomplish a desired heat exchanging effect at the outdoor heat exchanger 222, controlling the temperature of the output refrigerant is necessary.

Figure 2B:
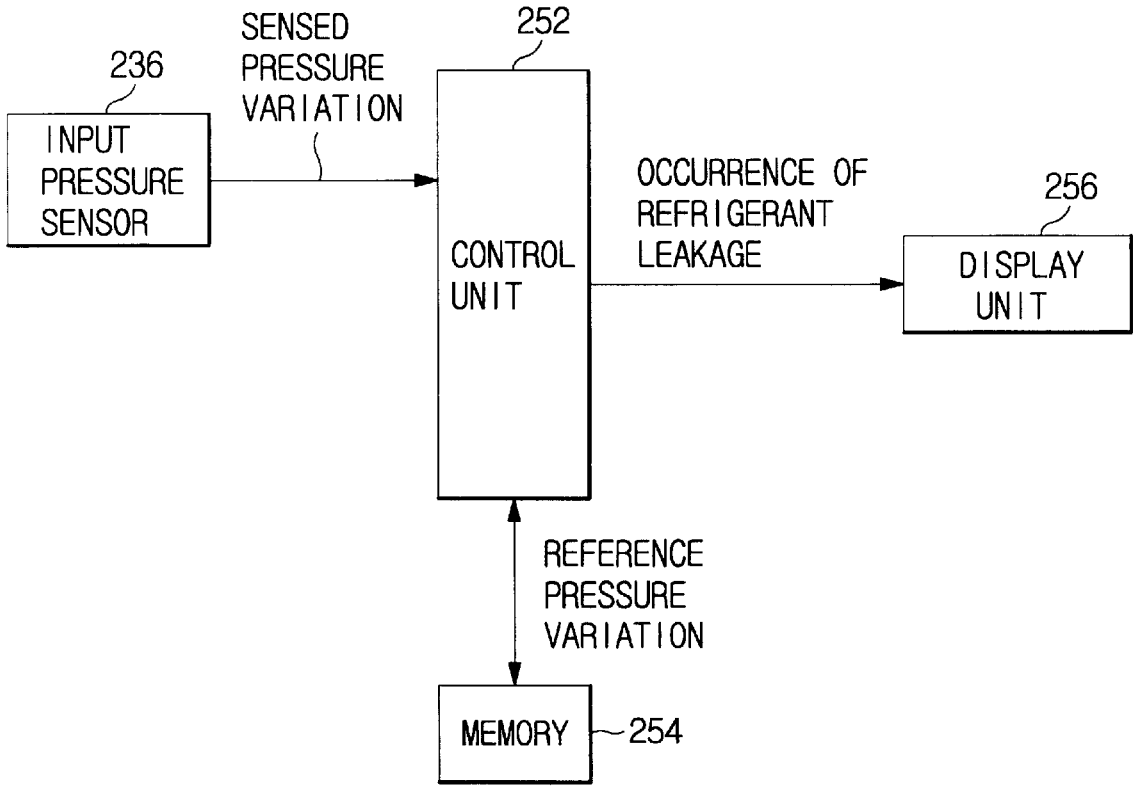
FIG. 2B is a block diagram, showing a concept of refrigerant leakage detection in the air conditioner of FIG. 2A.

FIG. 2B is a block diagram, showing a concept of the refrigerant leakage detection process in the air conditioner of FIG. 2A. In the air conditioner, a reference pressure variation value, which represents a reduction in the refrigerant pressure per unit time during a normal operation of the air conditioner without any refrigerant leakage, is stored in a form of data in a memory 254 such that a control unit 252 refers the stored data as reference data while detecting the refrigerant leakage. That is, the control unit 252 calculates a variation in input refrigerant pressure per unit time of the compressor 218 in response to an input signal from the output pressure sensor 236, and compares the calculated pressure variation with the reference pressure variation value stored in the memory 254 so as to determine whether a refrigerant leakage is occurring. When the refrigerant leakage from the refrigerant pipe is determined, information of the refrigerant leakage is displayed on a display unit 256.

When studying a refrigerant distribution in the refrigerant pipe of an air conditioner, a relatively higher pressure section and a relatively lower pressure section are present in the refrigerant pipe at the same time. That is, the output refrigerant discharged from the compressor 218 of the outdoor unit 204 has a relatively higher pressure, and the high pressure output refrigerant is reduced in pressure while passing through the outdoor expansion valve 228, thus becoming low pressure refrigerant. In the air conditioner, the section with the relative higher refrigerant pressure is set to a high pressure section, while the section with the relative lower refrigerant pressure is set to a low pressure section.

In order to accomplish a desired heat exchanging effect at the outdoor heat exchanger 222, a difference must be secured, higher than a predetermined level, between the temperatures of the outdoor air and the refrigerant. Since the refrigerant temperature varies in proportion to the refrigerant pressure, the refrigerant pressure is regulated such that the refrigerant pressure is in proportion to a sensed outdoor temperature. That is, the refrigerant pressure in the high pressure section must be in proportion to the outdoor temperature.

Figure 3A:
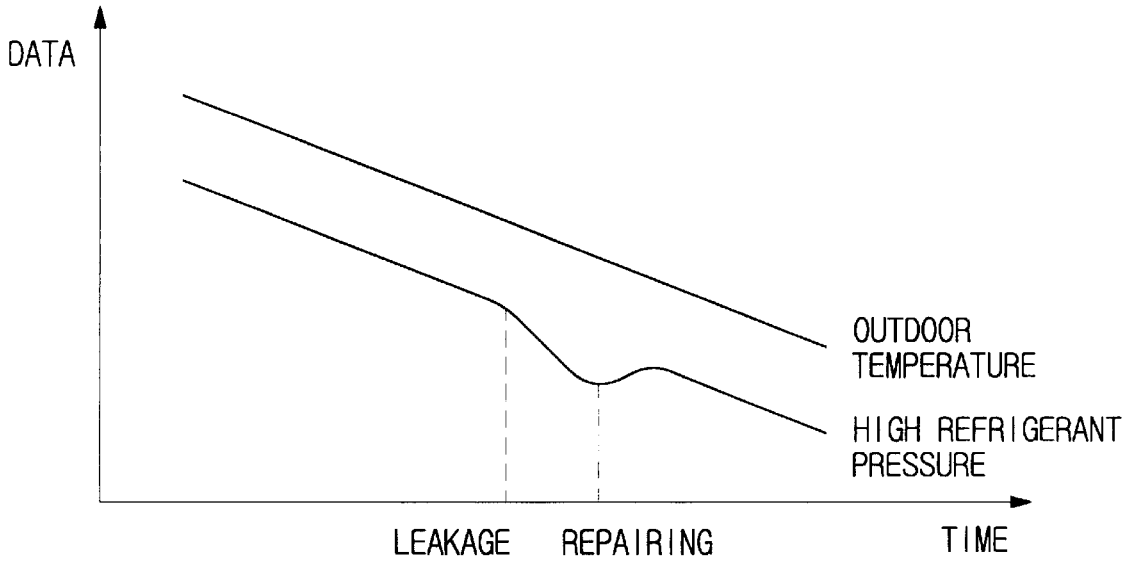
FIG. 3A is a diagrammatic view showing a pressure characteristic of a high pressure section of a refrigerant pipe included in the air conditioner of this invention.

The relation between the refrigerant pressure in the high pressure section and the outdoor temperature will be described as follows with reference to FIG. 3A. FIG. 3A is a diagrammatic view, showing the pressure characteristic of the high pressure section of the refrigerant pipe included in the air conditioner of FIG. 2A. As shown in FIG. 3A, when refrigerant leaks from the refrigerant pipe within the high pressure section, a variation in the refrigerant pressure of the high pressure section is larger than a variation in the outdoor temperature. Therefore, a refrigerant leakage is recognized from the refrigerant pipe when a result of a comparison of the refrigerant pressure variation in the high pressure section with the outdoor temperature variation represents that the refrigerant pressure variation is not in proportion to the outdoor temperature variation. As shown in FIG. 3A, initially when a refrigerant leakage occurs, the refrigerant pressure in the high pressure section is quickly reduced and is not in proportion to the outdoor temperature. However, after repairing a broken part of the refrigerant pipe causing the refrigerant leakage, the refrigerant does not further leak from the pipe, and so the refrigerant pressure is restored to a normal level of the refrigerant pressure. The amount of leaked refrigerant may need to be restored after repairing the broken part of the refrigerant pipe.

Figure 3B:
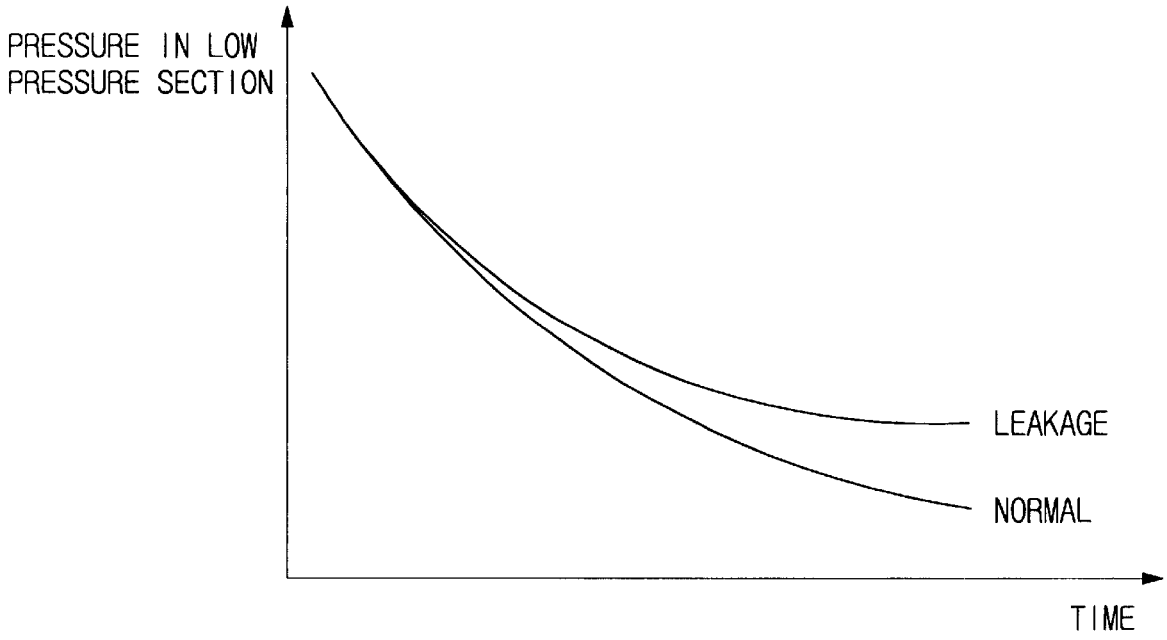
FIG. 3B is a diagrammatic view showing the pressure characteristic of a low pressure section of the refrigerant pipe of FIG. 2A.

FIG. 3B is a diagrammatic view, showing the pressure characteristic of the low pressure section of the refrigerant pipe. As shown in FIG. 3B, the high pressure refrigerant is quickly reduced in pressure while passing through the outdoor expansion valve 228, thus defining the low pressure section after the outdoor expansion valve 228. The reduction in the refrigerant pressure per unit time in the case of a refrigerant leakage in the low pressure section is smaller than the reduction in the refrigerant pressure per unit time in the case of a normal operation without having a refrigerant leakage. That is, when there is no refrigerant leakage in the low pressure section, refrigerant pressure is normally reduced by an action of the indoor expansion 214 valve mounted on the refrigerant pipe. However, when refrigerant leaks in the low pressure section, outside air is introduced into the refrigerant pipe through a broken part, and so refrigerant pressure is abnormally reduced. Therefore, in a method of detecting a refrigerant leakage in the air conditioner, an entire low pressure section of the refrigerant pipe is sectioned into two or more subsections, and a reduction in refrigerant pressure per unit time in each subsection of the low pressure section is detected. Thereafter, each of the detected reductions in refrigerant pressure of the subsections is compared with the reduction in refrigerant pressure per unit time in the case of a normal operation so as to determine whether a refrigerant leakage occurs in an associated subsection.

Figure 4:
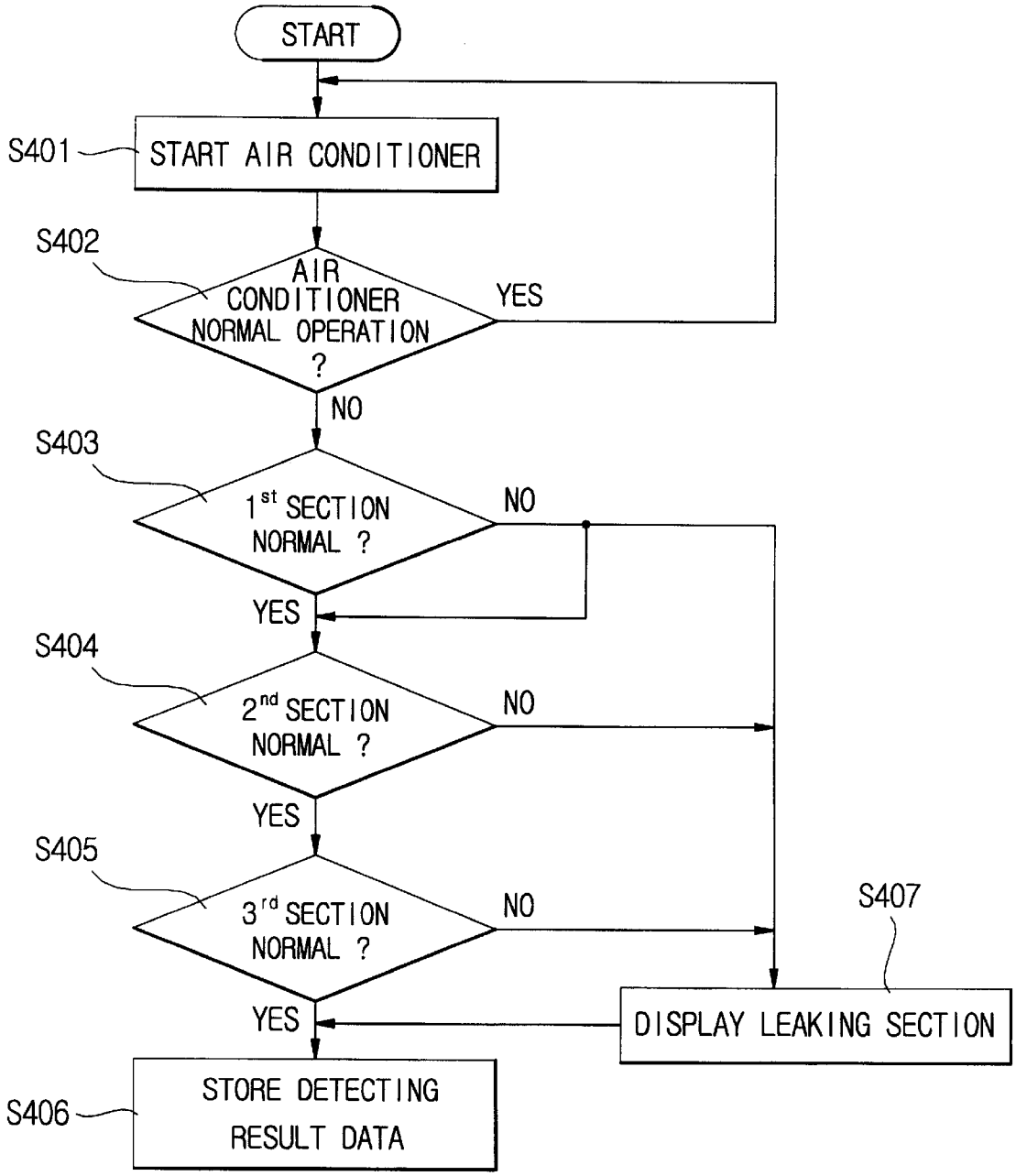
FIG. 4 is a flowchart of a method of detecting a refrigerant leakage in the air conditioner of FIG. 2A.

FIG. 4 is a flowchart of the method of detecting a refrigerant leakage in the air conditioner of FIG. 2A. As shown in FIG. 4, when the air conditioner starts an operation at S401, the refrigerant pressure variation in the high pressure section is compared with the outdoor temperature variation so as to determine whether a refrigerant leakage occurs from the refrigerant pipe, thus determining whether the air conditioner is operating normally at S402. When at S402 a refrigerant leakage is determined to have occurred from the refrigerant pipe, the first to third detecting sections are sequentially and separately checked at S403, S404 and S405 to determine in detail a position of a broken part causing the refrigerant leakage. That is, the first detecting section is primarily checked at step S403. When at S403 a refrigerant leakage is determined to have occurred in the first section, a sign representing the refrigerant leakage is displayed on a display unit 256 at S407. Thereafter, at S404, the second detecting section is secondarily checked. When at S404 a refrigerant leakage is determined to have occurred in the second section, a sign representing the refrigerant leakage is displayed on the display unit 256 at S407. The third detecting section is, thereafter, checked at S405. When at S405 a refrigerant leakage is determined to have occurred in the third section, a sign representing the leakage is displayed on the display unit 256 at S407. After sequentially checking the three sections, the refrigerant leakage checking results are stored in a form of data in a memory at S406. Such storage of the refrigerant leakage checking result data in the memory is for transmission of the data to a service station to allow a service man to quickly deal with the refrigerant leakage.

Figure 5:
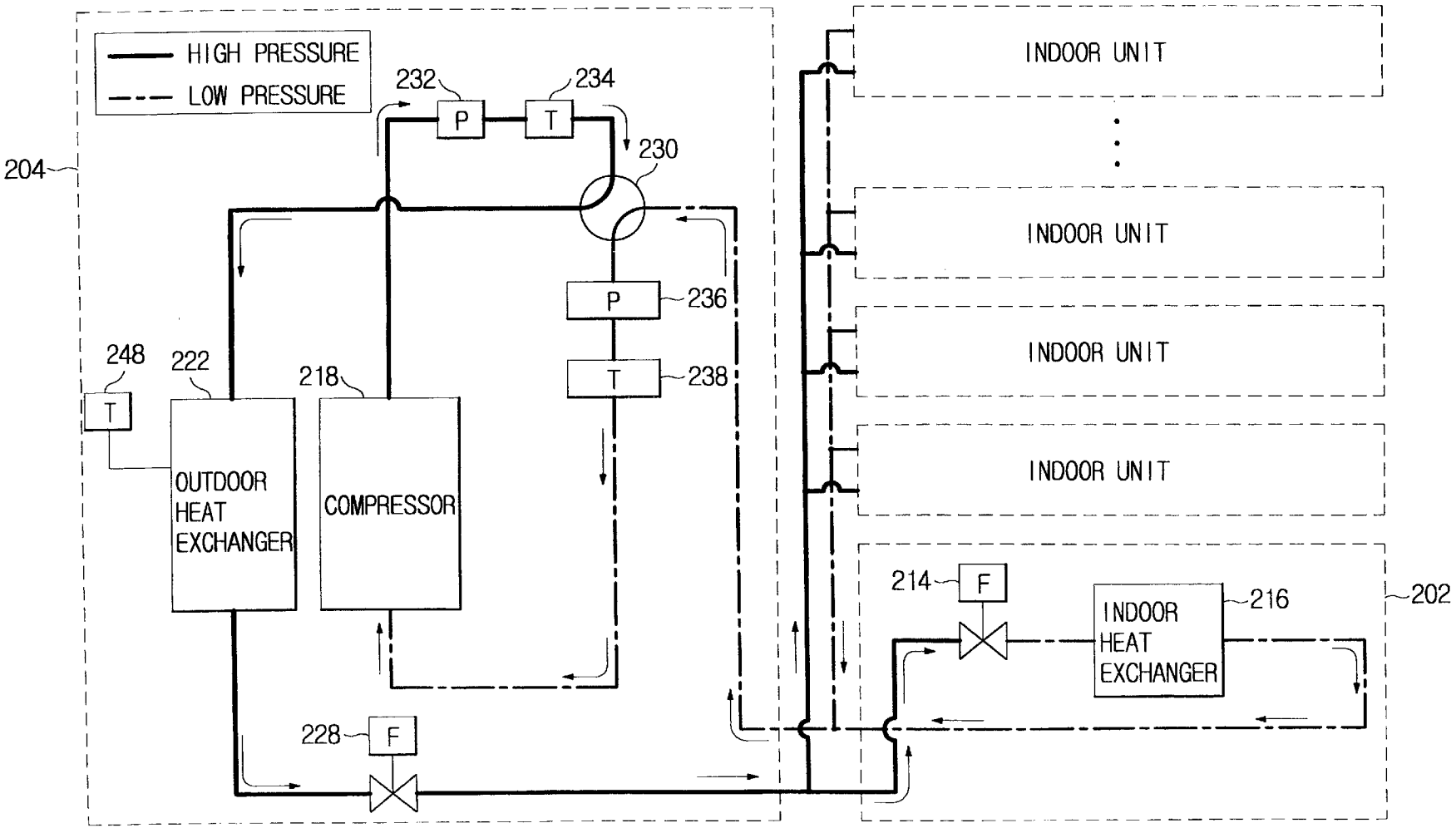
FIG. 5 is a block diagram, showing a refrigerant pressure distribution in the air conditioner of FIG. 2A during a cooling mode operation.

FIG. 5 is a block diagram, showing a refrigerant pressure distribution in the air conditioner during a cooling mode operation. In FIG. 5, the section shown by the solid line is a high pressure section, while the section shown by the dot-and-dash is a low pressure section. Pressure of the output refrigerant from the compressor 218 is very high.

However, when an opening ratio of the indoor expansion valve 214 is appropriately regulated, such high pressure refrigerant is reduced in pressure while passing through the indoor expansion valve 214. Therefore, the refrigerant pipe may be divided into the high pressure section and the low pressure section based on of the indoor expansion valve 214. The refrigerant pressure distribution shown in FIG. 5 is obtained from a cooling mode operation with both the opening ratio of the indoor expansion valve 214 appropriately regulated and the outdoor expansion valve 228 completely closed.

Figure 6:
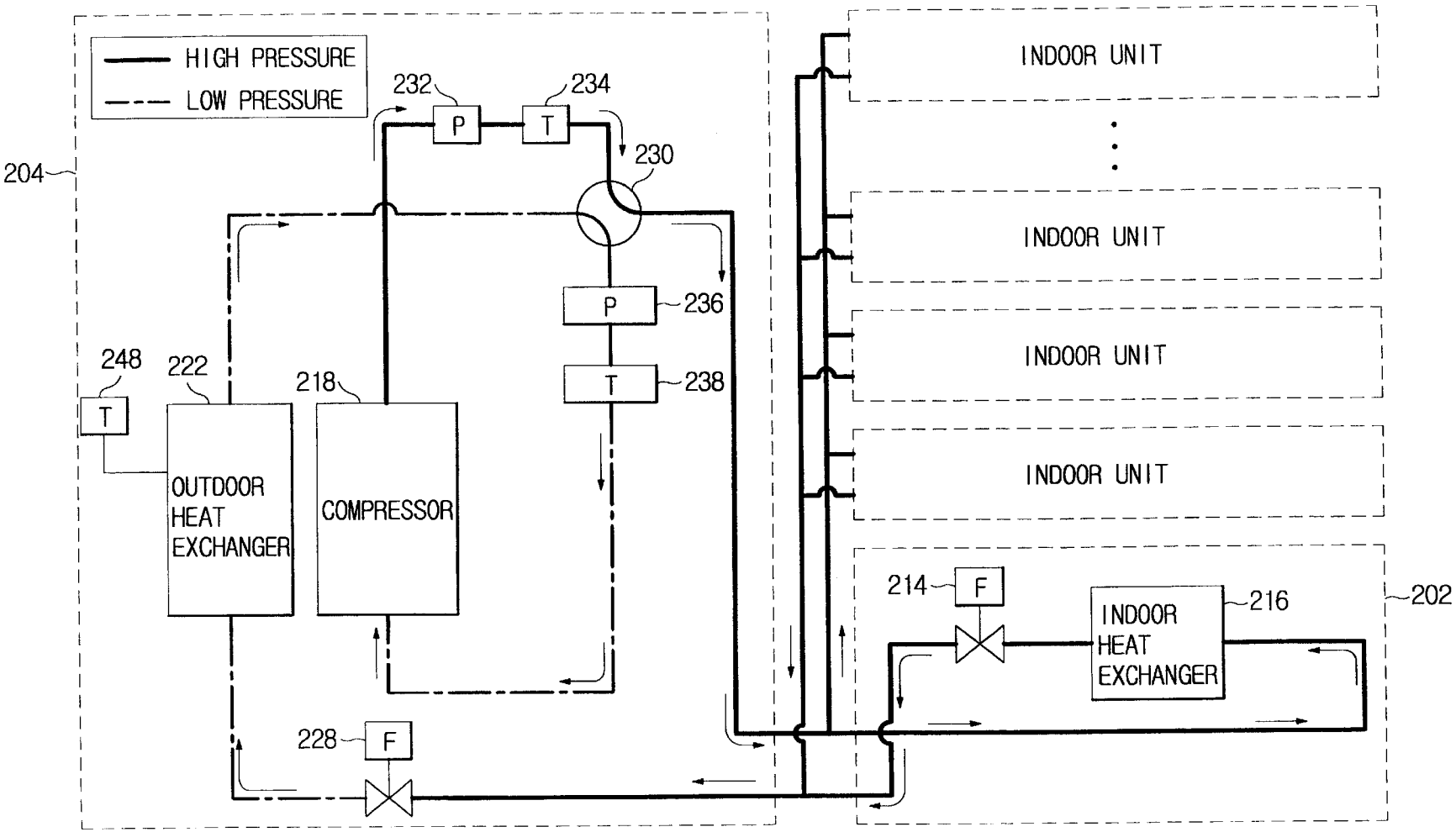
FIG. 6 is a block diagram, showing a refrigerant pressure distribution in the air conditioner of FIG. 2A during a heating mode operation.

FIG. 6 is a block diagram, showing a refrigerant pressure distribution in the air conditioner during a heating mode operation. In FIG. 6, the section shown by the solid line is a high pressure section, while the section shown by the dot-and-dash line is a low pressure section. The four-way valve 230 controls the refrigerant flow path such that the high pressure output refrigerant from the compressor 218 flows to the indoor heat exchanger 216, and controls the refrigerant flow path such that the refrigerant sequentially passing through the indoor and outdoor heat exchangers 216 and 222 returns to the compressor 218. Therefore, the refrigerant direction of flow of the air conditioner during the heating mode operation of FIG. 6 is different from that during the cooling mode operation of FIG. 5. The refrigerant pressure distribution shown in FIG. 6 is obtained from the heating mode operation in which both the indoor expansion valve 214 is completely opened (or appropriately opened to accomplish an appropriate opening ratio) and the opening ratio of the outdoor expansion valve 228 is appropriately regulated. Therefore, the refrigerant after passing through the outdoor expansion valve 228 is reduced in the pressure of the refrigerant.

As shown in FIGS. 5 and 6, the section of the refrigerant pipe between the outlet port of the compressor 218 and the four-way valve 230 is fixed to a high pressure section regardless of a selected operational mode of the air conditioner, that is, for either of the cooling mode operation or the heating mode operation. However, the remaining sections of the refrigerant pipe are changeable between high and low pressure sections in response to a flow path control of the four-way valve 230 which changes the direction of the refrigerant flow in the sections in accordance with a selected operational mode of the air conditioner.

Figure 7:
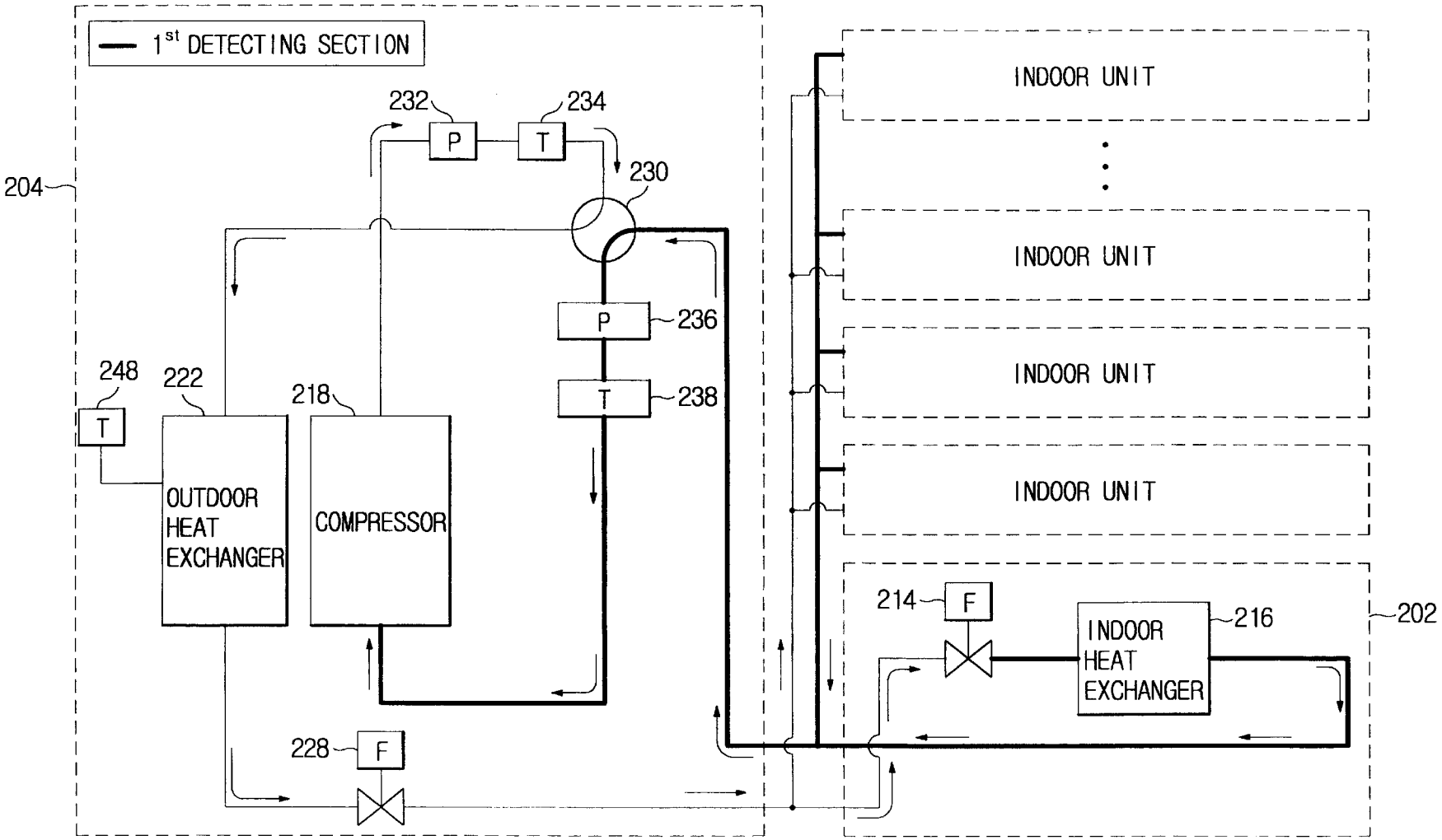
FIG. 7 is a block diagram, showing a first detecting section in the air conditioner of FIG. 2A.

FIG. 7 is a block diagram, showing the first detecting section in the air conditioner. In FIG. 7, the section of the refrigerant pipe, extending from the indoor expansion valve 214 to the inlet port of the compressor 218 while passing through the indoor heat exchanger 216 and the four-way valve 230, is the first detecting section. In this case, the air conditioner performs a cooling mode operation. During a refrigerant leakage detection mode, the indoor expansion valve 214 is completely closed, while the outdoor expansion valve 228 is completely opened. Reductions in the pressure and temperature of refrigerant in the first detecting section are sensed using the input pressure sensor 236 and the input temperature sensor 238, which are mounted on the refrigerant pipe extending to the inlet port of the compressor 218.

Figure 8:
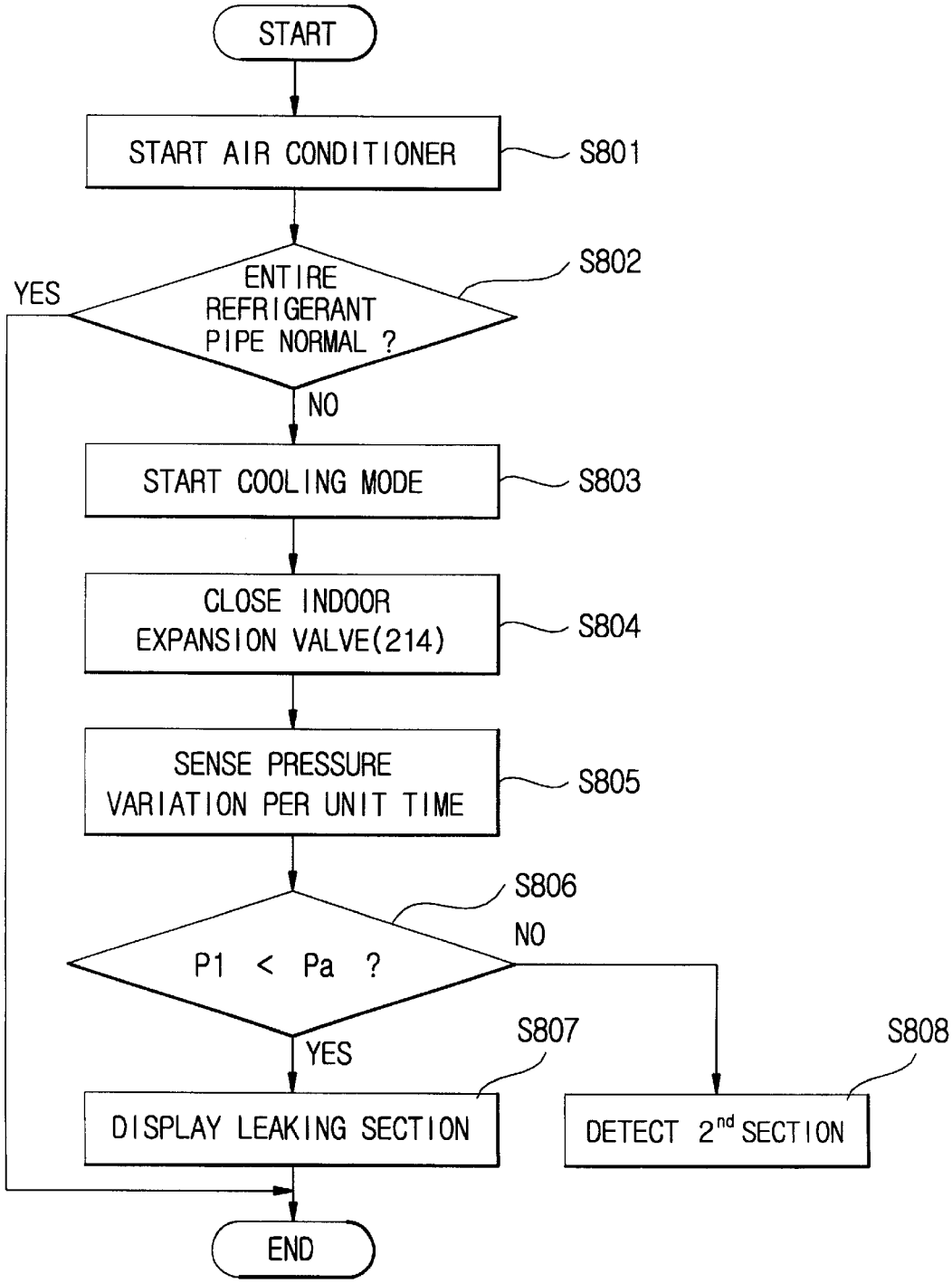
FIG. 8 is a flowchart of the process of detecting a refrigerant leakage in the first detecting section of FIG. 7.

FIG. 8 is a flowchart of a process of detecting a refrigerant leakage in the first detecting section. As shown in FIG. 8, when the air conditioner starts an operation of the air conditioner at S801, the refrigerant pressure variation in the high pressure section is compared with the indoor temperature variation so as to determine whether a refrigerant leakage from the refrigerant pipe is occurring, thus determining whether the air conditioner is operating normally at S802. When at S802 a refrigerant leakage from the refrigerant pipe is determined to have occurred, the first detecting section is checked at operations S803 to S808 to determine whether there is a refrigerant leakage in the first detecting section. That is, to check the first detecting section, the air conditioner is operated in a cooling mode at S803. When the indoor expansion valve 214 of the air conditioner of FIG. 7 is completely closed at S804, refrigerant pressure in the first detecting section is gradually reduced due to a suction force of the compressor 218. A reduction in the refrigerant pressure per unit time in such a case is measured at S805, and the measured pressure reduction is compared with the reduction in the refrigerant pressure per unit time in the case of a normal operation of the air conditioner with the indoor expansion valve 214 being completely closed, at S806. The pressure reduction of the first detecting section per unit time measured during a refrigerant leakage detection mode is set to P1, and the pressure reduction of the first detecting section per unit time measured during a normal operation without a refrigerant leakage is set to Pa. In the case of P1<Pa, a refrigerant leakage in the first detecting section is determined to have occurred. When a refrigerant leakage in the first detecting section is determined to have occurred, a sign of the refrigerant leakage in the first section is displayed on the display unit 256 at S807. However, when no refrigerant leakage in the first detecting section is determined, the control unit starts a process of detecting a refrigerant leakage in the second detecting section at S808.

Figure 9:
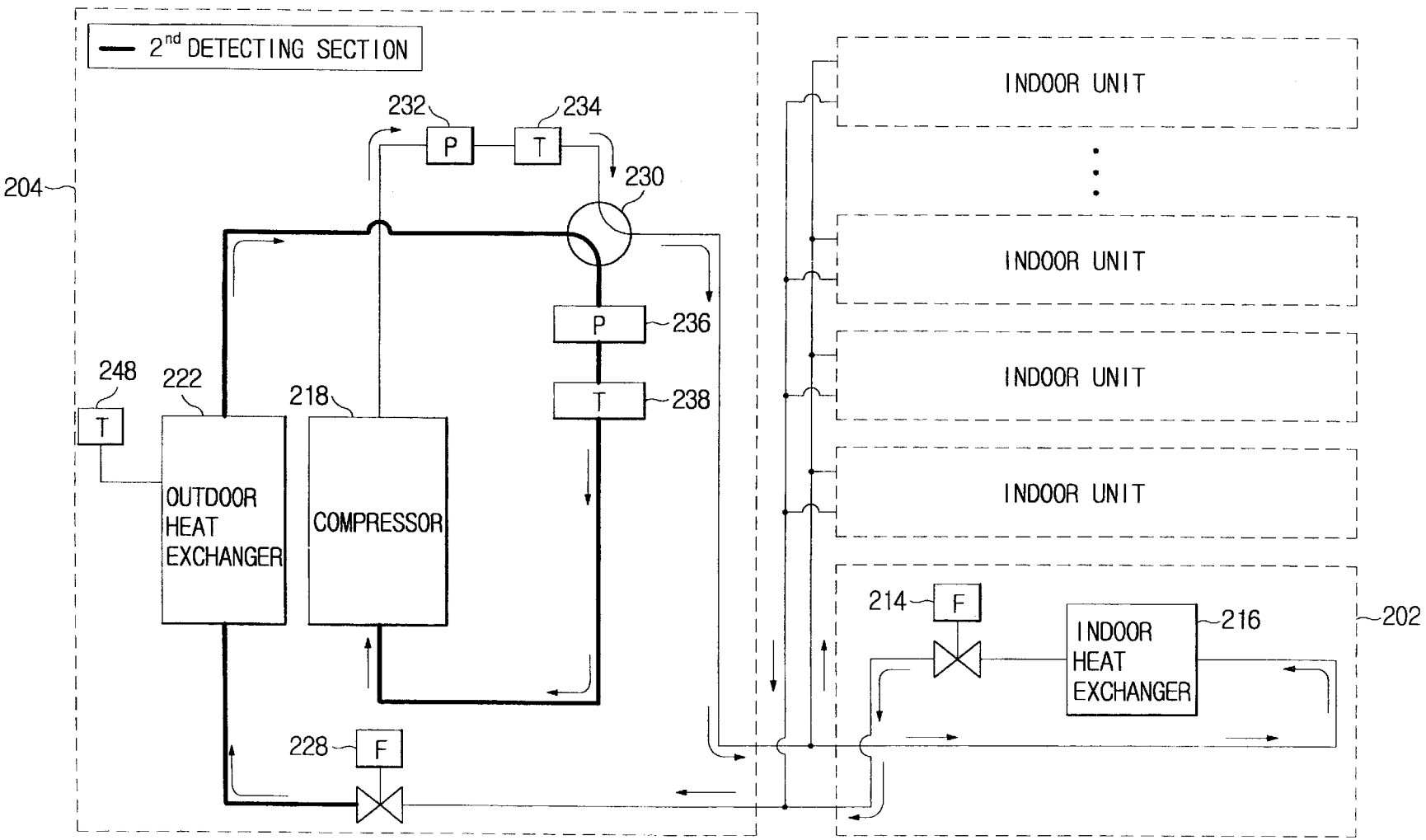
FIG. 9 is a block diagram, showing a second detecting section in the air conditioner of FIG. 2A.

FIG. 9 is a block diagram, showing the second detecting section in the air conditioner. In FIG. 9, the section of the refrigerant pipe, extending from the outdoor expansion valve 228 to the inlet port of the compressor 218 while passing through the outdoor heat exchanger 222 and the four-way valve 230, is the second detecting section. In this case, the air conditioner performs a heating mode operation. During the refrigerant leakage detection mode, the outdoor expansion valve 228 is completely closed, and reductions in the pressure and temperature of refrigerant in the second detecting section are sensed using the input pressure sensor 236 and the input temperature sensor 238, which are mounted on the refrigerant pipe extending to the inlet port of the compressor 218.

Figure 10:
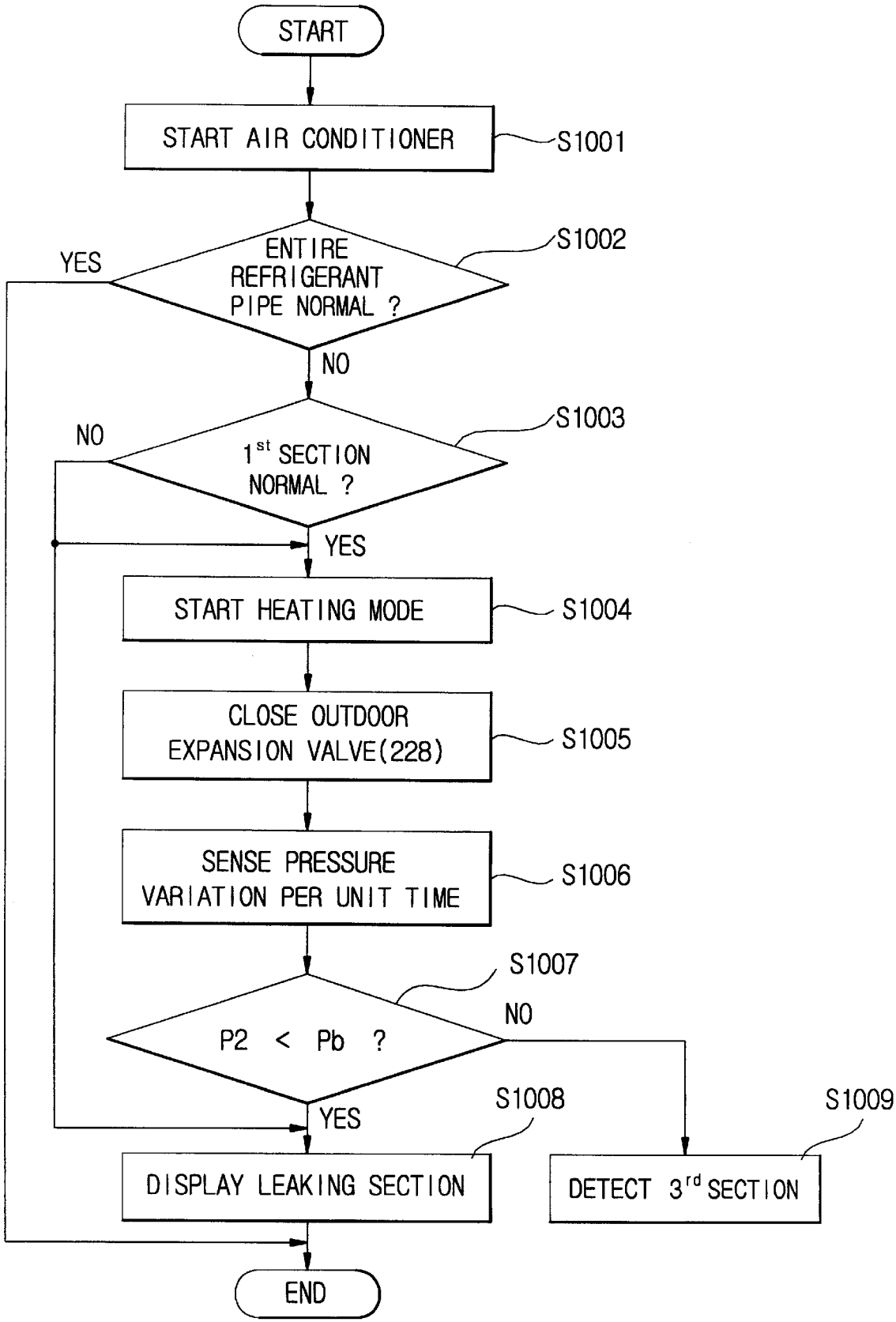
FIG. 10 is a flowchart of the process of detecting a refrigerant leakage in the second detecting section of FIG. 9.

FIG. 10 is a flowchart of a process of detecting a refrigerant leakage in the second detecting section. As shown in FIG. 10, when the air conditioner starts an operation of the air conditioner at S1001, the refrigerant pressure variation in the high pressure section is compared with the outdoor temperature variation so as to determine whether a refrigerant leakage from the refrigerant pipe is occurring, thus determining whether the air conditioner is operating normally at S1002. When at S1002 a refrigerant leakage from the refrigerant pipe is determined to have occurred, the first detecting section is checked at S1003 to determine whether there is a refrigerant leakage in the first detecting section. When at S1003 a refrigerant leakage in the first detecting section is determined, a sign of the refrigerant leakage in the first detecting section is displayed on the display unit 256 at S1008, and the second detecting section is checked at S1004 to S1009 to determine whether there is a refrigerant leakage in the second detecting section. Further, when no refrigerant leakage in the first detecting section is determined, a refrigerant leakage in the second detecting section is checked. In order to check the second detecting section, the air conditioner is operated in a heating mode at S1004. When the outdoor expansion valve 228 of the air conditioner is completely closed at S1005, the refrigerant pressure in the second detecting section is gradually reduced. A reduction P2 in the refrigerant pressure of the second detecting section per unit time in this case is measured at S1006, and the measured pressure reduction P2 is compared with a reduction Pb in the refrigerant pressure of the second detecting section per unit time in the case of a normal operation of the air conditioner with the outdoor expansion valve 228 completely closed, at S1007. In the case of P2<Pb, a refrigerant leakage in the second detecting section is determined to have occurred. When a refrigerant leakage in the second detecting section is determined to have occurred, a sign of the refrigerant leakage in the second section is displayed on the display unit 256 at S1008. However, when no refrigerant leakage in the second detecting section is determined, the control unit starts a process of detecting a refrigerant leakage in the third detecting section at S1009.

Figure 11:
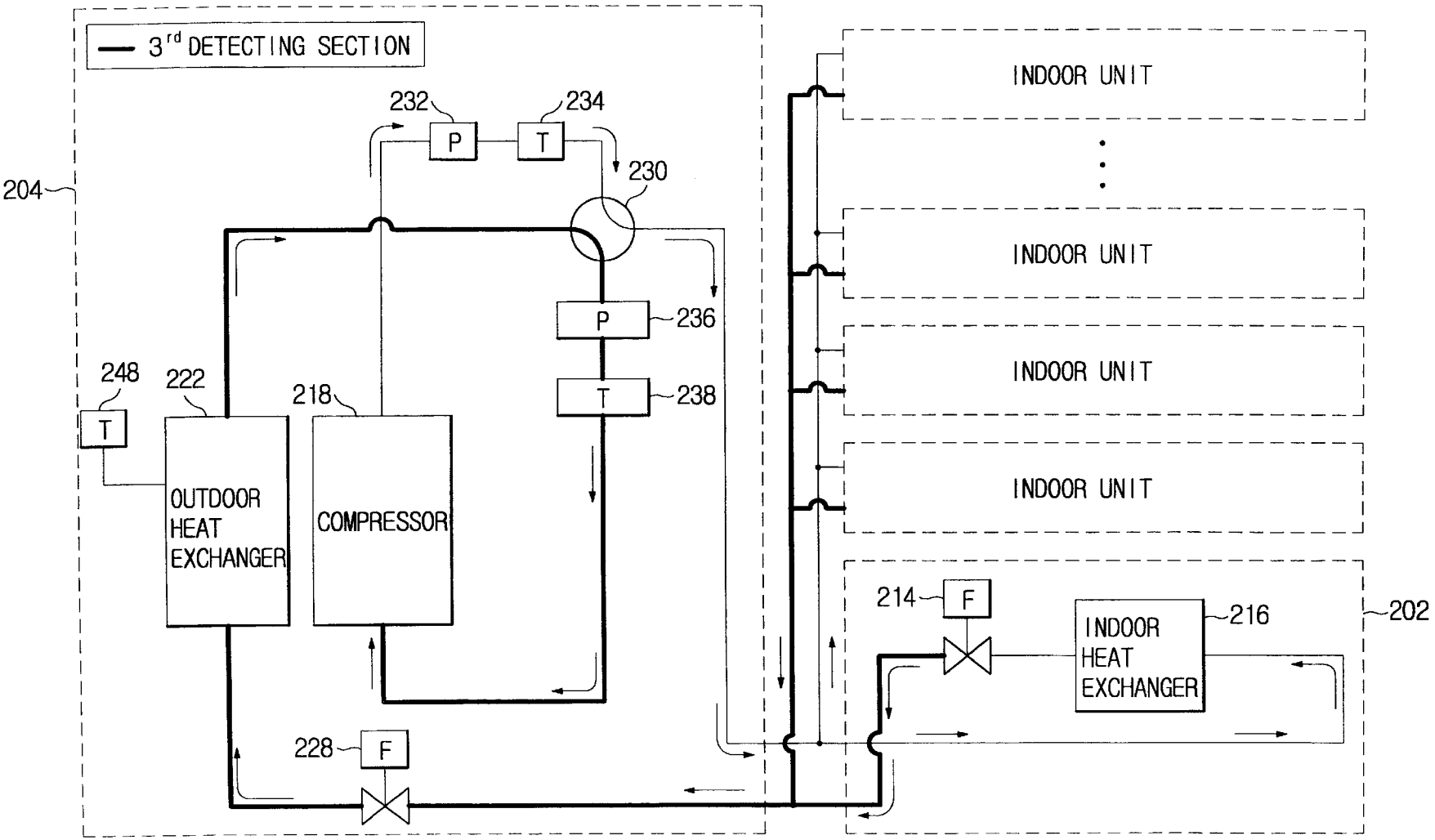
FIG. 11 is a block diagram, showing a third detecting section in the air conditioner of FIG. 2A.

FIG. 11 is a block diagram, showing the third detecting section in the air conditioner. In FIG. 11, the section of the refrigerant pipe, extending from the indoor expansion valve 214 to the inlet port of the compressor 218 while passing through the outdoor expansion valve 228, the outdoor heat exchanger 222 and the four-way valve 230, is the third detecting section. In this case, the section from the outdoor expansion valve 228 to the inlet port of the compressor 218 is the second detecting section, and the second section has been checked as to whether a refrigerant leakage in the second section has occurred as described above with reference to FIG. 10. Therefore, the third detecting section is recognized to be practically defined between the indoor expansion valve 214 and the outdoor expansion valve 228. When a refrigerant leakage is detected in the third detecting section under a condition that the second detecting section is determined to be normal and does not have a refrigerant leakage, the refrigerant leakage occurs in the section from the indoor expansion valve 214 to the outdoor expansion valve 228. Therefore, the refrigerant leakage detecting process for the third detecting section is performed assuming that the second detecting section is operating normally without having a refrigerant leakage. In order to detect a refrigerant leakage in the third section, the air conditioner performs a heating mode operation. After starting the heating mode operation of the air conditioner, a refrigerant leakage detection mode is performed with the indoor expansion valve 214 completely closed and the outdoor expansion valve 228 completely opened. Pressure and temperature reductions of the refrigerant in the third detecting section are sensed using the input pressure sensor 236 and the input temperature sensor 238.

Figure 12:
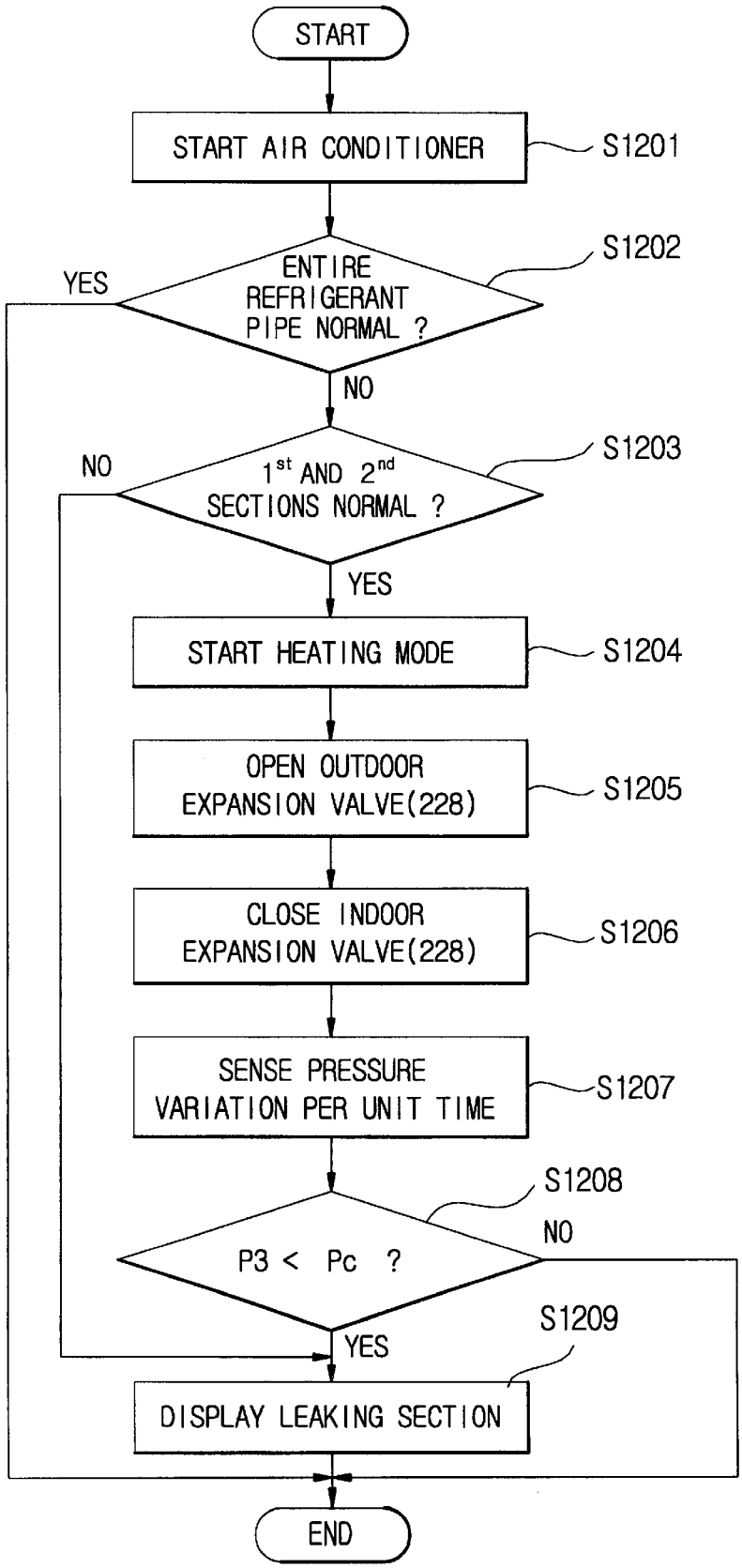
FIG. 12 is a flowchart of the process of detecting a refrigerant leakage in the third detecting section of FIG. 11.

FIG. 12 is a flowchart of the process of detecting a refrigerant leakage in the third detecting section. As shown in FIG. 12, when the air conditioner starts the operation at S1201, the refrigerant pressure variation in the high pressure section is compared with the outdoor temperature variation so as to determine whether a refrigerant leakage from the refrigerant pipe occurs, thus determining whether the air conditioner is operating normally at S1202. When at S1202 a refrigerant leakage from the refrigerant pipe is determined to have occurred, the first and second detecting sections are checked at S1203 to determine whether a refrigerant leakage in the first and second detecting sections occurred. When at S1203 no refrigerant leakage in the first and second detecting sections occurred, the third detecting section is checked at operations S1204 to S1209 to determine whether a refrigerant leakage in the third section occurred. In order to check the third detecting section, the air conditioner is operated in a heating mode at S1204. The outdoor expansion valve 228 of the air conditioner of FIG. 11 is completely opened at S1205, and the indoor expansion valve 214 is completely closed at S1206. In this case, the refrigerant pressure in the third detecting section is gradually reduced. A reduction P3 in the refrigerant pressure of the third detecting section per unit time in this case is measured at S1207, and the measured pressure reduction P3 is compared with a reduction Pc in the refrigerant pressure of the third detecting section per unit time in the case of a normal operation of the air conditioner with both the outdoor expansion valve 228 completely opened and the indoor expansion valve 214 completely closed, at S1208. In the case of P3<Pc, a refrigerant leakage in the third detecting section is determined to have occurred. When a refrigerant leakage in the third detecting section is determined to have occurred, a sign of the refrigerant leakage in the third section is displayed on the display unit 256 at S1209.

In the refrigerant leakage detecting method, the detecting processes for the first to third detecting sections may be sequentially performed as described above. Alternatively, the detecting processes for the three sections may be selectively performed as desired. However, the leakage detecting process for the third section is performed based on the assumption that the second section is operating normally without having a refrigerant leakage. The selective leakage detecting process for the three sections may be easily accomplished by the use of drive software provided in the control unit 252 and user interface. That is, a batch-processing routine and selective processing routines of the refrigerant leakage detecting method are provided in the drive software of the control unit. Since the batch-processing and selective processing routines of the drive software cooperate with the user interface, a user may select the batch-processing routine or the selective processing routines as desired through the user interface.

As described above, an air conditioner and a method of detecting a refrigerant leakage in the air conditioner is provided. In the leakage detecting method, a refrigerant leakage in the entire refrigerant pipe is primarily detected, thus determining whether a refrigerant leakage occurred. Thereafter, the first to third detecting sections of the refrigerant pipe are checked through a batch-processing routine or selective processing routines to quickly determine whether a refrigerant leakage occurs in the first to third sections, as well as quickly finding the exact position of a broken or loosened area of the refrigerant pipe in the case of a refrigerant leakage, thus allowing a service man to quickly repair the broken or loosened area of the refrigerant pipe. The air conditioner effectively accomplishes the refrigerant leakage detecting mechanism only by addition of pressure and temperature sensors on the refrigerant pipe of a conventional air conditioner, and thereby is advantageous in that it does not force the air conditioner to be provided with additional hardware, which is expensive and complicates construction and production processes of the air conditioner.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An air conditioner, comprising a compressor, an expansion valve, an outdoor heat exchanger, and an indoor heat exchanger connected to each other by a refrigerant pipe, said refrigerant pipe being sectioned into a high pressure section extending from an outlet port of the compressor to an inlet port of the expansion valve, and a low pressure section extending from an outlet port of the expansion valve to an inlet port of the compressor, the air conditioner comprising:

a pressure sensor provided on the refrigerant pipe within said low pressure section; and a control unit detecting a refrigerant leakage in the low pressure section by comparing a variation in refrigerant pressure sensed by the pressure sensor with a preset variation in refrigerant pressure in accordance with a normal operation associated with no refrigerant leakage, during a refrigerant leakage detection mode.

2. The air conditioner according to claim 1, wherein said control unit determines that the refrigerant leakage in the low pressure section occurred, when the variation in refrigerant pressure sensed by the pressure sensor is less than the preset variation in refrigerant pressure in accordance with the normal operation, during the refrigerant leakage detection mode.

3. The air conditioner according to claim 1, further comprising:

a four-way valve, the four way valve being provided on the refrigerant pipe controlling a refrigerant flowing direction in the refrigerant pipe, a section of the refrigerant pipe between the outlet port of the compressor and the four-way valve is fixed to a high pressure section in which refrigerant maintains high pressure during an operation of the air conditioner, a second section of the refrigerant pipe between the four-way valve and the inlet port of the compressor is fixed to a low pressure section in which the refrigerant maintains low pressure during the operation of the air conditioner, a remaining section of the refrigerant pipe is switched between the high pressure section and the low pressure section in accordance with the refrigerant flowing direction in the refrigerant pipe, and said pressure sensor is provided within said section fixed to the low pressure section.

4. The air conditioner according to claim 3, wherein said control unit detects the refrigerant leakage in the low pressure section while switching the high pressure section and the low pressure section, during the refrigerant leakage detection mode.

5. An air conditioner, comprising:

a compressor, an outdoor heat exchanger;

a n indoor heat exchanger;

an indoor expansion valve;

an outdoor expansion valve; and a four-way valve controlling a refrigerant flowing direction, which are connected to each other by a refrigerant pipe, wherein said refrigerant pipe includes a first detecting section extending from the indoor expansion valve to an inlet port of the compressor while passing through the indoor heat exchanger and the four-way valve, a second detecting section extending from the outdoor expansion valve to the inlet port of the compressor while passing through the outdoor heat exchanger and the four-way valve, and a third detecting section extending from the indoor expansion valve to the inlet port of the compressor while passing through the outdoor expansion valve, the outdoor heat exchanger and the four-way valve;

a pressure sensor is provided on the refrigerant pipe at a position between the four-way valve and the inlet port of the compressor; and a control unit is provided to detect a refrigerant leakage in each of the first, second and third detecting sections by comparing a variation in refrigerant pressure of each section sensed by said pressure sensor with a preset variation in the refrigerant pressure in accordance with a normal operation of each of the sections associated with no refrigerant leakage, during a refrigerant leakage detection mode.

6. The air conditioner according to claim 5, wherein said control unit determines whether a refrigerant leakage occurs in the third detecting section, after determining that a refrigerant leakage in the second detecting section has not occurred.

7. The air conditioner according to claim 5, wherein said control unit determines that a refrigerant leakage has occurred in a low pressure section, when the variation in the refrigerant pressure sensed by the pressure sensor is less than the preset variation in the refrigerant pressure in accordance with the normal operation, during the refrigerant leakage detection mode.

8. A method of detecting a refrigerant leakage in an air conditioner, said air conditioner comprising a compressor, an outdoor heat exchanger, an indoor heat exchanger, an indoor expansion valve installed indoors, an outdoor expansion valve installed outdoors, and a four-way valve controlling a refrigerant flowing direction so as to allow the air conditioner to selectively perform a cooling mode operation or a heating mode operation, which are connected to each other by a refrigerant pipe, said refrigerant pipe including a first detecting section extending from the indoor expansion valve to an inlet port of the compressor while passing through the indoor heat exchanger and the four-way valve, and a second detecting section extending from the outdoor expansion valve to the inlet port of the compressor while passing through the outdoor heat exchanger and the four-way valve, with a pressure sensor provided on the refrigerant pipe at a position between the four-way valve and the inlet port of the compressor, the method comprises:

closing one expansion valve associated with the first detecting section to be detected or the second detecting section to be detected, and opening a remaining expansion valve associated with a section, which is not subjected to leakage detection, when a refrigerant leakage detection mode is started;

receiving a signal indicating a sensed variation in refrigerant pressure of a respective detected section per unit time, said signal outputted from the pressure sensor; and comparing the sensed variation in refrigerant pressure with a preset variation in refrigerant pressure in accordance with a normal operation associated with no refrigerant leakage of the respective detected section, and determining that a refrigerant leakage in the respective detected section has occurred, when the sensed variation is less than the preset variation.

9. The method according to claim 8, wherein the first and second detecting sections are sequentially detected during the refrigerant leakage detection mode.

10. The method according to claim 9, further comprising:

displaying the respective detected section where a refrigerant leakage is determined to have occurred.

11. The method according to claim 9, wherein said refrigerant pipe further comprises a third detecting section extending from the indoor expansion valve to the inlet port of the compressor while passing through the outdoor expansion valve, the outdoor heat exchanger and the four-way valve; and detecting the refrigerant leakage in the third detecting section with the indoor expansion valve being closed and the outdoor expansion valve being opened.

12. The method according to claim 11, wherein the detecting the refrigerant leakage in the third detecting section is performed, in response to determining that the refrigerant leakage in the second detecting section has not occurred.

13. The method according to claim 8, wherein the detecting the refrigerant leakage in each of the detecting sections is sequentially performed in response to determining that the refrigerant leakage in an entire refrigerant pipe has occurred.

14. A method of detecting a refrigerant leakage in an air conditioner, said air conditioner comprising a compressor, an outdoor heat exchanger, an indoor heat exchanger and an expansion valve, each interconnected by a refrigerant pipe, the method comprising:

sectioning said refrigerant pipe into at least two refrigerant leakage detecting sections; and comparing a detected variation in a refrigerant pressure in each of the detecting sections with a preset variation in the refrigerant pressure in accordance with a normal operation associated with no refrigerant leakage of a corresponding detected section.

15. An air conditioner having a compressor, an expansion valve, an outdoor heat exchanger, and an indoor heat exchanger, each interconnected by a refrigerant pipe, said refrigerant pipe being sectioned into a plurality of sections, comprising:

a pressure sensor provided on the refrigerant pipe within one of the plurality of sections; and a control unit detecting a refrigerant leakage in the one of the plurality of sections by comparing a change in a refrigerant pressure level sensed by the pressure sensor with a predetermined change in the refrigerant pressure level in accordance with a normal operation associated with no refrigerant leakage of the respective one section.

16. An air conditioner having a compressor, an expansion valve, an outdoor heat exchanger, and an indoor heat exchanger, comprising:

a refrigerant pipe interconnecting each of said compressor, said expansion valve, said outdoor heat exchanger, and said indoor heat exchanger, said refrigerant pipe being sectioned into a high pressure section extending from an outlet port of the compressor to an inlet port of the expansion valve, and a low pressure section extending from an outlet port of the expansion valve to an inlet port of the compressor;

a pressure sensor provided on the refrigerant pipe within a first section of the plurality of sections; and a control unit detecting a refrigerant leakage in the first section by comparing a change in a refrigerant pressure level sensed by the pressure sensor with a predetermined change in the refrigerant pressure level in accordance with a normal operation associated with no refrigerant leakage in the first section.

17. A method of detecting a refrigerant leakage in an air conditioner, the air conditioner having a compressor, expansion valves, an outdoor heat exchanger, and an indoor heat exchanger, each interconnected by a refrigerant pipe, comprising:

sectioning the refrigerant pipe into a plurality of sections;

sensing a pressure level of a refrigerant within a first section of the plurality of sections of the refrigerant pipe; and comparing a change in the sensed pressure level of the refrigerant with a predetermined change in the refrigerant pressure level in accordance with a normal operation associated with no refrigerant leakage in the first section of the plurality of sections; and detecting a refrigerant leakage in accordance with a result of the comparing.

18. The method according to claim 17, wherein the sectioning further comprises:

closing one expansion valve associated with the first section to be detected, and opening a remaining expansion valve associated with a second section, which is not subjected to leakage detection.

19. The method according to claim 17, wherein when the first section is a low pressure section the detecting further comprises:

determining that the refrigerant leakage occurred in the first section if the change in the sensed pressure level of the refrigerant is less than the predetermined change in the refrigerant pressure level associated with no refrigerant leakage in the first section.

20. The method according to claim 17, wherein when the first section is a high pressure section the detecting further comprises:

sensing an outdoor temperature; and determining that the refrigerant leakage occurred in the first section if the change in the sensed pressure level of the refrigerant is not proportional to a variation in the outdoor temperature.

21. The method according to claim 17, wherein the detecting the refrigerant leakage in the first section of the plurality of sections is based on a detected result of one or more remaining sections of the plurality of sections.

22. The method according to claim 17, wherein the sectioning further comprises:

fixing the refrigerant pipe between an outlet port of the compressor and the four-way valve to a high pressure section in which refrigerant maintains high pressure during an operation of the air conditioner;

fixing the refrigerant pipe between the four-way valve and an inlet port of the compressor to a low pressure section in which the refrigerant maintains low pressure during the operation of the air conditioner; and switching a remainder of the refrigerant pipe between the high pressure section and the low pressure section in accordance with an operational mode of the air conditioner during a refrigerant leakage detection mode.

23. The method according to claim 17, wherein the sensing further comprises:

receiving a signal indicating a change in refrigerant pressure per unit time of the first section to be detected outputted from a pressure sensor.

24. The method according to claim 17, wherein the sensing further comprises:

sequentially sensing each of the plurality of sections of the refrigerant pipe during a refrigerant leakage detection mode.

25. An air conditioner having a compressor, an outdoor heat exchanger, an indoor heat exchanger, an indoor expansion valve, an outdoor expansion valve, and a four-way valve, comprising;

a first detecting section extending from the indoor expansion valve to an inlet port of the compressor while passing through the indoor heat exchanger and the four-way valve;

a second detecting section extending from the outdoor expansion valve to the inlet port of the compressor while passing through the outdoor heat exchanger and the four-way valve; and a third detecting section extending from the indoor expansion valve to the inlet port of the compressor while passing through the outdoor expansion valve, the outdoor heat exchanger and the four-way valve; and a control unit having a sensor to sense variations in refrigerant pressure with respect to a preset level of one or more sections sensed by the sensor according to a pressure level in the one or more sections.

26. The method according to claim 25, wherein the first, second and third detecting sections are sequentially detected during a refrigerant leakage detection mode.

* * * * *